US008297451B2

(12) United States Patent
Dewberry et al.

(10) Patent No.: US 8,297,451 B2
(45) Date of Patent: Oct. 30, 2012

(54) STACKABLE STEMS

(75) Inventors: Jeff Dewberry, Bremen, GA (US); Frank Calhoun, Carrollton, GA (US); Robert Creed, Carrollton, GA (US)

(73) Assignee: Southwire Company, Carrollton, GA (US)

( * ) Notice: Subject to any disclaimer, the term of this patent is extended or adjusted under 35 U.S.C. 154(b) by 0 days.

(21) Appl. No.: 13/416,005

(22) Filed: Mar. 9, 2012

(65) Prior Publication Data

US 2012/0160794 A1 Jun. 28, 2012

Related U.S. Application Data

(62) Division of application No. 12/354,061, filed on Jan. 15, 2009, now Pat. No. 8,136,681.

(51) Int. Cl.
*A47F 3/14* (2006.01)

(52) U.S. Cl. ..... 211/60.1; 211/126.7; 211/181.1

(58) Field of Classification Search ..... 211/60.1, 211/194, 74, 85.18, 181.1, 14, 88.03, 85.23, 211/56, 58, 129.1, 131.1, 49.1, 126.2, 126.7, 211/126.8, 126.9, 126.11, 126.12, 133.6, 211/71.01, 188

See application file for complete search history.

(56) References Cited

U.S. PATENT DOCUMENTS

| | | | |
|---|---|---|---|
| 1,095,687 | A | 5/1914 | Wenger |
| 1,112,558 | A | 10/1914 | Red |
| 1,190,152 | A | 7/1916 | Gross |
| 2,051,091 | A | 8/1936 | Ladewig et al. |
| 2,213,677 | A | 9/1940 | Miller |
| 2,538,612 | A | 1/1951 | Wuollet |
| 2,552,983 | A | 5/1951 | Lee |
| 2,756,901 | A | 7/1956 | Cowsert |
| 3,628,474 | A | 12/1971 | Rehwaldt |
| 4,077,514 | A | 3/1978 | Kubokawa |
| 4,561,547 | A | 12/1985 | Estwanik, III |
| 4,836,392 | A | 6/1989 | Constantino |
| 4,955,485 | A | 9/1990 | Alton |
| 1,938,466 | A | 12/1993 | Rubenstein |
| 5,546,771 | A | 8/1996 | Bonar |
| 5,553,707 | A | 9/1996 | Lion |
| 5,765,700 | A | 6/1998 | Donne |
| 5,810,181 | A | 9/1998 | Emalfarb et al. |

(Continued)

OTHER PUBLICATIONS

Fabritex—Products & Services, Copyright 2008-2010, Site Design & Hosting by dscTech, Inc., http://www.fabritex.com/products_services.htm, 1 pg.

(Continued)

*Primary Examiner* — Jennifer E. Novosad
(74) *Attorney, Agent, or Firm* — Merchant & Gould

(57) ABSTRACT

A stem may comprise a circular base, a plurality of outer ears, and a plurality of outer uprights. The circular base may have a circular outer perimeter centered on a center point of the circular base. The plurality of outer ears may protrude outwardly from the circular outer perimeter. The plurality of outer uprights may be respectively connected to each of the plurality of outer ears at a bottom end of each of the plurality of outer uprights. The plurality of outer uprights may be substantially parallel with each other and may be substantially perpendicular to the circular base. The stem may be configured to allow an additional stem to mateable stack inside the stem. The additional stem may be rotated (with respect to the stem) an incremental amount such that sides of outer ears of the additional stem may respectively contact sides of the outer uprights of the stem.

23 Claims, 4 Drawing Sheets

U.S. PATENT DOCUMENTS

| | | | | |
|---|---|---|---|---|
| 5,833,080 | A | 11/1998 | Donne | |
| 6,053,335 | A | 4/2000 | Rutter | |
| 6,942,109 | B2 | 9/2005 | Aros et al. | |
| 7,340,859 | B2 | 3/2008 | Palsrok | |
| 7,398,888 | B1 | 7/2008 | Nowak | |
| 7,856,756 | B1 | 12/2010 | Caruso | |
| 8,136,681 | B2 * | 3/2012 | Dewberry et al. | 211/126.7 |
| 2006/0037925 | A1 | 2/2006 | Wood et al. | |
| 2008/0264883 | A1 | 10/2008 | Stafford et al. | |
| 2009/0020491 | A1 | 1/2009 | Foster | |
| 2009/0159543 | A1 | 6/2009 | Burgess et al. | |
| 2010/0176073 | A1 | 7/2010 | Dewberry et al. | |

OTHER PUBLICATIONS

Fabritex—Stem Packs, Copyright 2008-2010, Site Design & Hosting by dscTech, Inc., http://www.fabritex.com/stem_packs.htm, 2 pgs.

* cited by examiner

STACKABLE STEMS

RELATED APPLICATIONS

This application is a Divisional of U.S. application Ser. No. 12/354,061 entitled "Stackable Stems" filed Jan. 15, 2009, and issued as U.S. Pat. No. 8,136,681 on Mar. 20, 2012, which is incorporated herein by reference in its entirety.

COPYRIGHTS

All rights, including copyrights, in the material included herein are vested in and the property of the Applicants. Applicants retain and reserve all rights in the material included herein, and grant permission to reproduce the material only in connection with reproduction of the granted patent and for no other purpose.

BACKGROUND

Stems are used in the wire manufacturing industry to receive and store wire at certain points in the manufacturing process. For example, as wire comes off a manufacturing line, the wire may be paid-off to a stem for storage. Once the wire is stored in the stem, the stem may be transported to a different section of a plant or may even be transported to another plant in a different part of the country. Because a large number of stems may be used and because space in a manufacturing facility comes at a premium, being able to store empty stems in a compact way is desirable.

SUMMARY

This Summary is provided to introduce a selection of concepts in a simplified form that are further described below in the Detailed Description. This Summary is not intended to identify key features or essential features of the claimed subject matter. Nor is this Summary intended to be used to limit the claimed subject matter's scope.

A stem may be provided. The stem may comprise a circular base, a plurality of outer ears, and a plurality of outer uprights. The circular base may have a circular outer perimeter centered on a center point of the circular base. The plurality of outer ears may protrude outwardly from the circular outer perimeter. The plurality of outer uprights may be respectively connected to each of the plurality of outer ears at a bottom end of each of the plurality of outer uprights. The plurality of outer uprights may be substantially parallel with each other and may be substantially perpendicular to the circular base.

Both the foregoing general description and the following detailed description provide examples and are explanatory only. Accordingly, the foregoing general description and the following detailed description should not be considered to be restrictive. Further, features or variations may be provided in addition to those set forth herein. For example, embodiments may be directed to various feature combinations and subcombinations described in the detailed description.

BRIEF DESCRIPTION OF THE DRAWINGS

The accompanying drawings, which are incorporated in and constitute a part of this disclosure, illustrate various embodiments of the present invention. In the drawings.

DETAILED DESCRIPTION

Figure 1A:
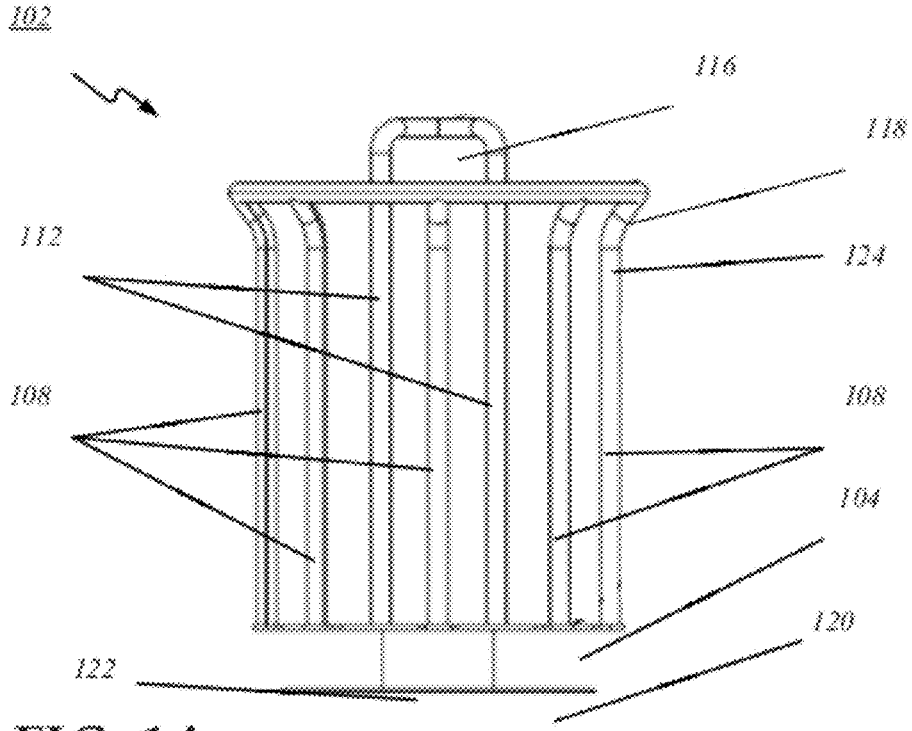
FIGS. 1A-1D show a stem.
Figure 1B:
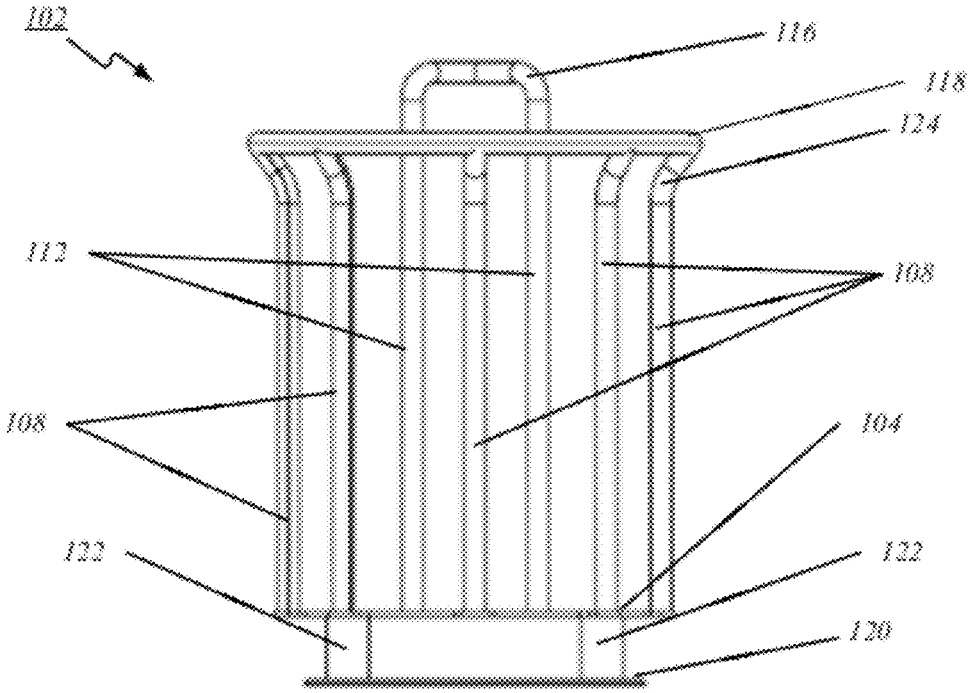
Figure 1C:
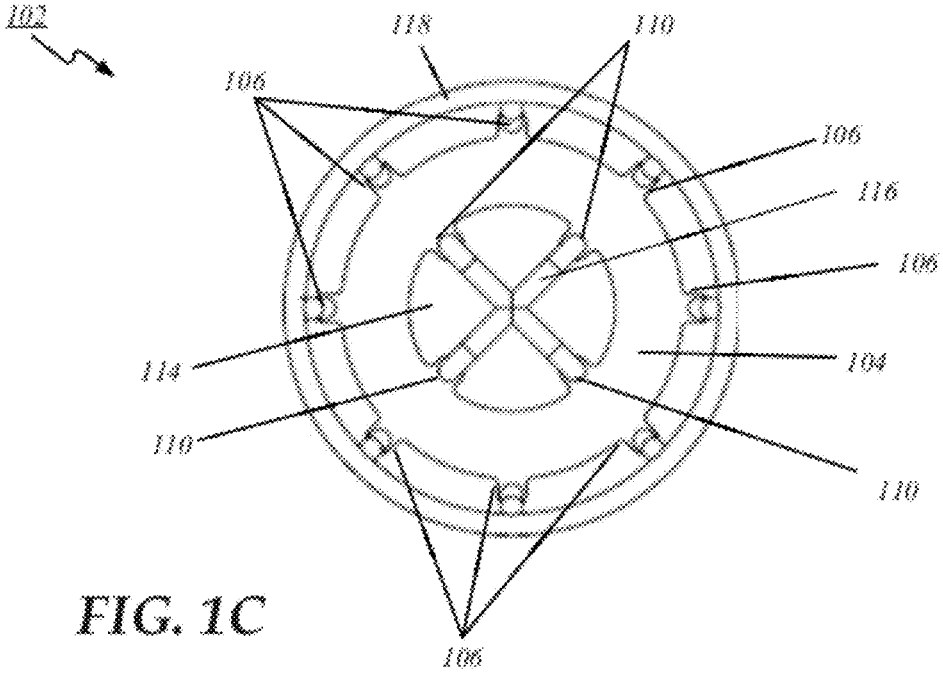
Figure 1D:
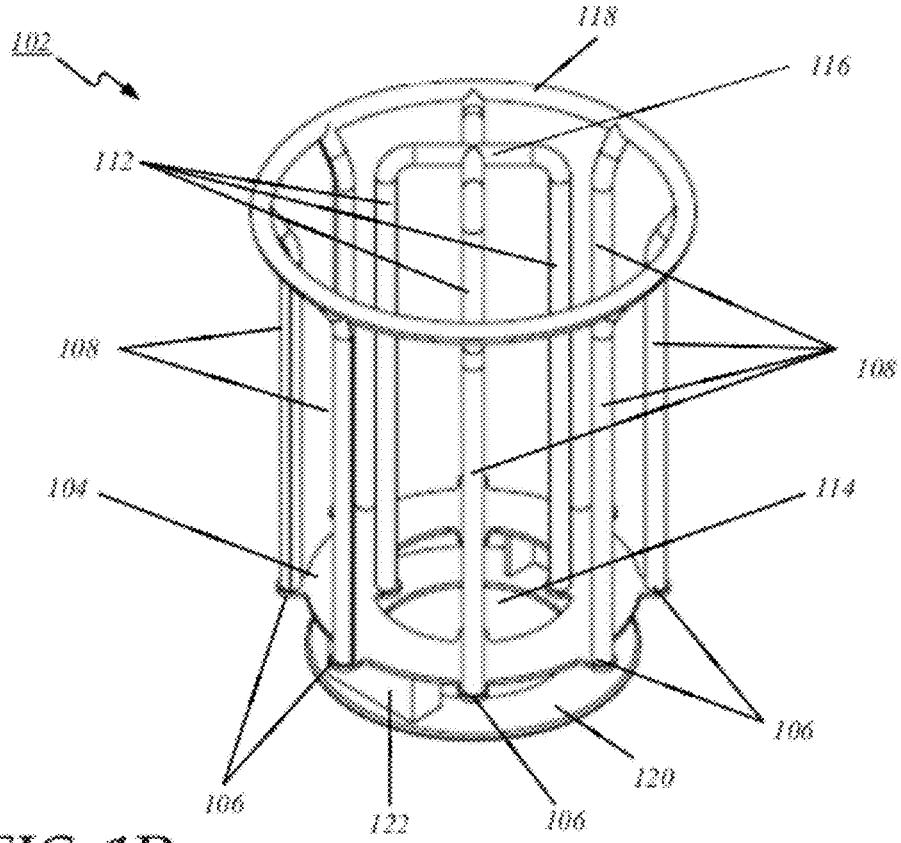

The following detailed description refers to the accompanying drawings. Wherever possible, the same reference numbers are used in the drawings and the following description to refer to the same or similar elements. While embodiments of the invention may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the invention.

FIGS. 1A-1D show a stem 102. Stem 102 may comprise a circular base 104, a plurality of outer ears 106, and a plurality of outer uprights 108. Circular base 104 may have a circular outer perimeter centered on a center point of circular base 104. Plurality of outer ears 106 may protrude outwardly from the circular outer perimeter. Plurality of outer uprights 108 may be respectively connected to each of plurality of outer ears 106 at a bottom end of each of plurality of outer uprights 108. Plurality of outer uprights 108 may be substantially parallel with each other and substantially perpendicular to circular base 104.

Stem 102 may further comprise a circular inner perimeter on circular base 104, a plurality of inner ears 110, and a plurality of inner uprights 112. The circular inner perimeter may be centered on the center point of circular base 104. Plurality of inner ears 110 may protrude inwardly from the circular inner perimeter. The circular inner perimeter and plurality of inner ears 110 may define an opening 114 in circular base 104. Plurality of inner uprights 112 may be respectively connected to each of plurality of inner ears 110 at a bottom end of each of plurality of inner uprights 112. Plurality of inner uprights 112 may be substantially parallel with each other and substantially perpendicular to circular base 104.

Plurality of inner ears 110 may be located symmetrically to one another around the circular inner perimeter. In addition, plurality of outer ears 106 may be located symmetrically to one another around the circular inner perimeter. Plurality of inner uprights 112 may be substantially parallel with plurality of outer uprights 108. Moreover, plurality of outer uprights 108 may be greater in number than plurality of inner uprights 112. For example, there may be four inner uprights and eight outer uprights.

All or portions of stem 102 may be constructed from various materials including, but not limited to, metals and plastics. For example, stem 102 may be constructed from an aluminum alloy or an impact resistant plastic such as PVC. Plurality of outer uprights 108 may be connected to circular base 104 via processes including, but not limited to, welding, adhesives, and mechanical fasteners. For example, if stem 102 is manufactured from a metal, plurality of outer uprights 108 may be bolted or welded to plurality of outer ears 106. If stem 102 is manufactured from a plastic, for example, plurality of outer uprights 108 may be attached to plurality of outer ears 106 via ultrasonic welding, epoxies, or bolts.

Plurality of inner uprights 112 may have various cross-sectional shapes. Cross-sectional shapes for plurality of inner uprights 112 may include, for example, circular, triangular, rectangular, pentagonal, hexagonal, heptagonal, and octagonal. Just as plurality of inner uprights 112 may have various cross-sectional shapes, plurality of outer uprights 108 may have various cross-sectional shapes. Cross-sectional shapes for plurality of outer uprights 108 may include, for example, circular, triangular, rectangular, pentagonal, hexagonal, heptagonal, and octagonal.

Stem 102 may further comprise a top end 116. Top end 116 may connect each of plurality of inner uprights 112 to each other. In addition, stem 102 may further comprise an outer ring 118 connected to a top end of each of plurality of outer uprights 108.

Stem 102 may comprise a base plate 120 and at least one spacer 122. Spacer 122 may be located between base plate 120 and circular base 104. Spacer 122's height may vary. For example, spacer 122's height may be such that lifting members of a forklift or a pallet jack are able to fit between base plate 120 and circular base 104. In addition, plurality of outer uprights 108 may comprise an offset 124. Offset 124 may allow outer ring 118 to have a diameter that is greater than a diameter of circular base 104. This may facilitate inserting another second stem into stem 102 as described in greater detail below.

Base plate 120 may contain mounting hardware (not shown) or preconfigured holes (not shown) for mounting stem 102 to machinery or securing stem 102 to a surface. For instance, stem 102 may contain a mounting bracket that may allow stem 102 to be mounted to machine. In addition, base plate 120 may contain holes so that stem 102 may be bolted to a surface (e.g., a floor).

Just as with connecting plurality of outer uprights 108 to plurality of outer ears 106, plurality of inner uprights 112 may be connected to plurality of inner ears 110 via processes including, but not limited to, welding, adhesives, and mechanical fasteners. Top end 116 may be connected to each of plurality of inner uprights 112 via the aforementioned connection processes. Base plate 120 and spacer 122 may be connected to circular base 104 via the aforementioned connection processes. In addition, circular base 104 may further comprise a plurality of notches configured to allow a second set of the plurality outer uprights and a second set of the plurality of inner uprights corresponding to another stem to pass through the plurality of notches of circular base 104.

Figure 2:
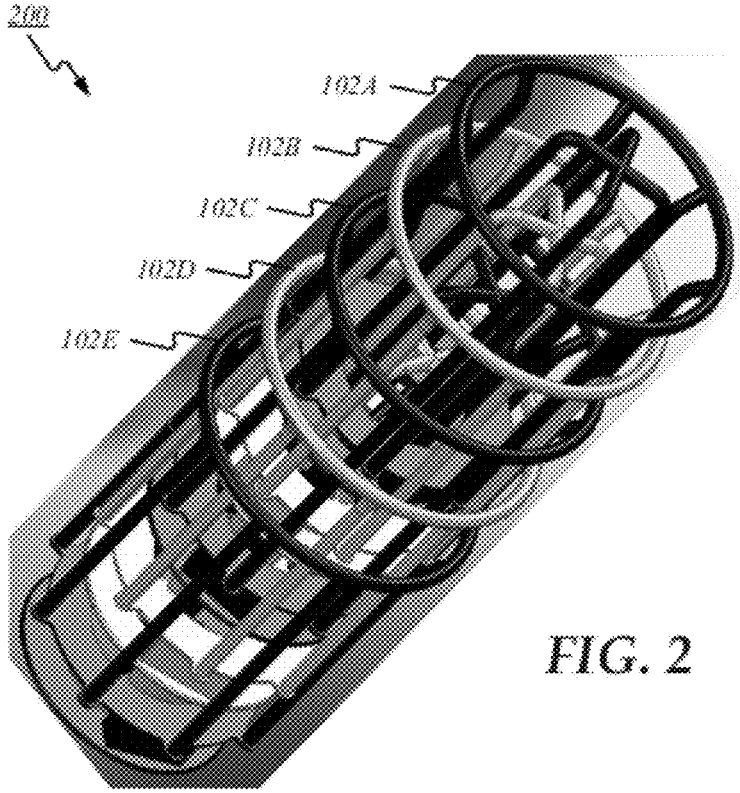
FIG. 2 shows a perspective view of multiple stacked stems.
Figure 3:
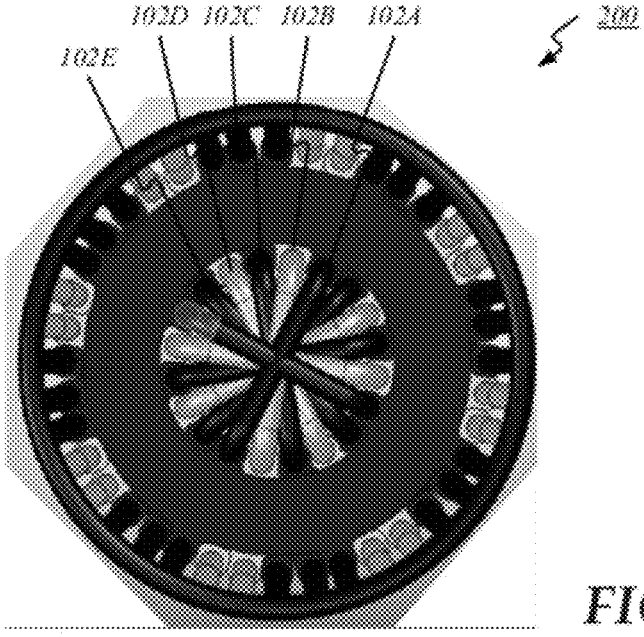
FIG. 3 shows a top view of multiple stacked stems.

FIGS. 2 and 3 show a perspective and top view, respectively, of a system 200 of stackable stems. System 200 may comprise stems 102A, 102B, 102C, 102D, and 102E, each of which may be similar to stem 102 as described above. While FIGS. 2 and 3 show five stems mateably stacked inside each other, system 200 will be described in terms of two stems. For example, stem 102A may be mateably stacked inside stem 102B. When stem 102A is mateably stacked inside stem 102B, the plurality of outer uprights of stem 102B may be substantially parallel with the plurality of outer uprights of stem 102A. The mateable stackability described may be practiced with any number of stems and is not limited to two stems.

Each of stem 102A, 1028, 102C, 102D, and 102E may comprise the same or similar construction of one another and may each include the same elements as stem 120 as described above with respect to FIGS. 1A through 1D. As shown in FIG. 2 and FIG. 3, the plurality of outer ears of stem 102A may be configured to index with the plurality of outer uprights of stem 102B. Indexing (i.e. or being configured to index) may comprise a process such that as an additional stem is inserted into a receiving stem in system 200, the additional stem is rotated (with respect to the receiving stem) an incremental amount such that the sides of the outer ears of the additional stem may respectively contact the sides of the outer uprights of the receiving stem already in system 200. Like stem 102, stems 102A, 102B, 102C, 102D, and 102E of system 200 may each respectively comprise base plates similar to base plate 120 and spacers similar to spacer 122.

Figure 4:
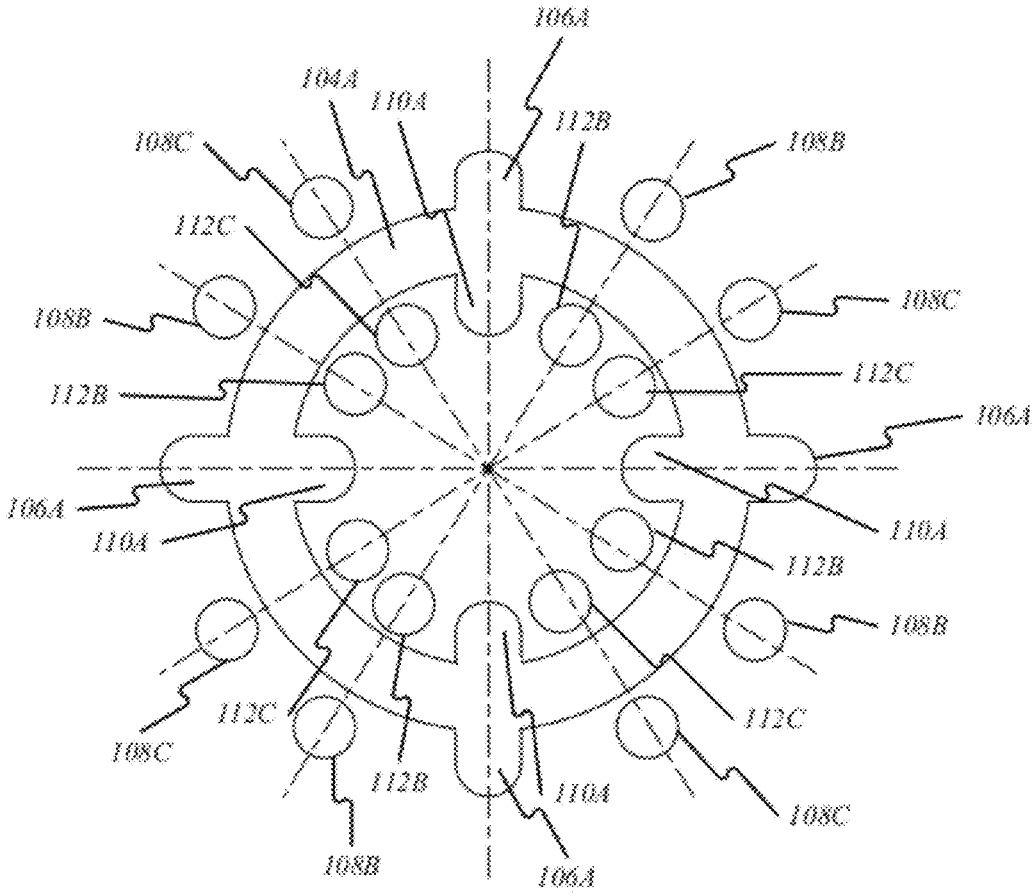
FIG. 4 shows an indexing schematic.

FIG. 4 describes indexing stems 102A, 102B, and 102C. As shown in FIG. 4, a circular base 104A, a plurality of outer ears 106A, and a plurality of inner ears 110A may correspond to stem 102A and may be respectively similar to circular base 104, plurality of outer ears 106, and a plurality of inner ears 110 as described above. Furthermore a plurality of outer uprights 1088 and a plurality of inner uprights 1128 may correspond to stem 1028 and may be respectively similar to plurality of outer uprights 108 and plurality of inner uprights 112 as described above. Moreover, a plurality of outer uprights 108C and a plurality of inner uprights 112C may correspond to stem 102C and may be respectively similar to plurality of outer uprights 108 and plurality of inner uprights 112 as described above.

In order for stems 102A, 102B, and 102C to index, there may be a distance between ones of plurality of inner ears 110A. The distance between ones of plurality of inner ears 110A may be defined as D=(d)(x). In this equation, for example, "D" may be the distance between one of plurality of inner ears 110A, "d" may be a cross-sectional dimension of one of plurality of inner uprights 112B and one of plurality of inner uprights 112C. The cross-sectional dimension may be the largest dimension of one of plurality of inner uprights 112B's and one of plurality of inner uprights 112C's cross-sectional area. For example, if plurality of inner uprights 112B and plurality of inner uprights 112C are circular, "d" may be the circular diameter of each of plurality of inner uprights 112B and each plurality of inner uprights 112C. If plurality of inner uprights 112B and plurality of inner uprights 112C are rectangular, "d" may be the longest side of a rectangle making up one of plurality of inner upright 112B's and one of plurality of inner upright 112C's cross-section. "x" may be an integer. For example, "x" may be an integer defining how many stems may be mateably stacked in system 200.

As shown in FIG. 4, plurality of inner uprights 112B and plurality of inner uprights 112C may be ½ in. circular bars, for example. In this example, "x" may be 3 and "D" may be 1 and ½ in. "d" may include a tolerance factor. For example, if plurality of inner uprights 112B and plurality of inner uprights 112C are ½ in. circular bars, "d" may be ⅝ in. or 9/16 in. Therefore, the tolerance factor may be ⅛ in. and 1/16 in., respectively. The tolerance factor, for example, may be used to account for irregularities during manufacturing so that stem 102A, stem 102B, and stem 102C may mateably stack together smoothly without binding.

Just as with plurality of inner ears 110A, in order for stem 102A, stem 102B, and stem 102C to index, there may be a distance between plurality of outer ears 106A. The distance between ones of plurality of outer ears 106A may be defined as D=(d)(x). In this equation, for example, "D" may be the distance between ones of plurality of outer ears 106A and "d" may be a cross-sectional dimension of ones of plurality of outer uprights 108B and ones of plurality of outer uprights 108C. The cross-sectional dimension may be the largest dimension of ones of plurality of outer uprights 108B's and ones of plurality of outer uprights 108C's cross-sectional area. For example, if plurality of outer uprights 108B and plurality of outer uprights 108C are circular, "d" may be the diameter of each of plurality of outer uprights 108B and each of plurality of outer uprights 108C. If plurality of outer uprights 108B and plurality of outer uprights 108C are rectangular, "d" may be the longest side of a rectangle making up plurality of outer upright 108B's and plurality of outer upright 108C's cross-section. "x" may be an integer. For example, "x" may be an integer defining how many stems may be mateably stacked in system 200.

Consistent with embodiments of the invention, "d" as described above may include a tolerance factor. The tolerance factor may be used to account for irregularities during manufacturing so that, for example, stems 102A, 102B, and 102C of system 200 fit together smoothly without binding.

While certain embodiments of the invention have been described, other embodiments may exist. Further, any disclosed methods' stages may be modified in any manner, including by reordering stages and/or inserting or deleting stages, without departing from the invention. While the specification includes examples, the invention's scope is indicated by the following claims. Furthermore, while the specification has been described in language specific to structural features and/or methodological acts, the claims are not limited to the features or acts described above. Rather, the specific features and acts described above are disclosed as example for embodiments of the invention.

What is claimed is:

1. A system of stackable stems, the system comprising:

a first stem comprising:

a first circular base having a first circular outer perimeter centered on a first center point of the first circular base, a first set of a plurality of outer ears protruding outwardly from the first circular outer perimeter, and a first set of a plurality of outer uprights being respectively connected to each of the first set of the plurality of outer ears at a bottom end of each of the first set of the plurality of outer uprights, the first set of the plurality of outer uprights being substantially parallel with each other and being substantially perpendicular to the first circular base; and a second stem comprising:

a second circular base having a second circular outer perimeter centered on a second center point of the second circular base, a second set of a plurality of outer ears protruding outwardly from the second circular outer perimeter, and a second set of a plurality of outer uprights being respectively connected to each of the second set of the plurality of outer ears at a bottom end of each of the second set of the plurality of outer uprights, the second set of the plurality of outer uprights being substantially parallel with each other and being substantially perpendicular to the second circular base, the second stem being mateably stacked inside the first stem causing the first set of the plurality of outer uprights to be substantially parallel with the second set of the plurality of outer uprights, wherein the first circular base further comprises a plurality of notches configured to allow the second set of the plurality outer uprights to pass through the plurality of notches.

2. The system of claim 1, wherein the first set of the plurality of outer ears are configured to index with the second set of the plurality of outer uprights.

3. The system of claim 1, wherein the plurality of outer ears in the first set of the plurality of outer ears are spaced a distance apart, the distance being defined as:

$$D=(d)(x),$$

where

D is the distance between the first set of the plurality of outer ears, d is a largest cross-sectional dimension of one of the second set of the plurality of outer uprights, and x is an integer.

4. The system of claim 1, wherein the first stem further comprises:

a first base plate; and a first spacer located between the first base plate and the circular base.

5. The system of claim 1, wherein:

the first stem further comprises:

a first circular inner perimeter on the first circular base, the first circular inner perimeter being centered on the first center point of the first circular base;

a first set of a plurality of inner ears protruding inwardly from the first circular inner perimeter, the first circular inner perimeter and first set of the plurality of inner ears defining an opening in the first circular base; and a first set of a plurality of inner uprights being respectively connected to each of the first set of the plurality of inner ears at a bottom end of each of the first set of the plurality of inner uprights, the first set of the plurality of inner uprights being substantially parallel with each other and being substantially perpendicular to the first circular base; and the second stem further comprises:

a second circular inner perimeter on the second circular base, the second circular inner perimeter being centered on the second center point of the second circular base;

a second set of a plurality of inner ears protruding inwardly from the second circular inner perimeter, the second circular inner perimeter and the second set of the plurality of inner ears defining an opening in the second circular base; and a second set of a plurality of inner uprights being respectively connected to each of the set of the plurality of inner ears at a bottom end of each of the set of the plurality of inner uprights, the second set of the plurality of inner uprights being substantially parallel with each other and being substantially perpendicular to the second circular base.

6. A system comprising:

a first stem comprising:

a first circular base having a first circular outer perimeter centered on a first center point of the first circular base, a first plurality of outer ears protruding outwardly from the first circular outer perimeter, a first plurality of outer uprights being respectively connected to each of the first plurality of outer ears at a first bottom end of each of the first plurality of outer uprights, the first plurality of outer uprights being substantially parallel with each other, a circular inner perimeter on the first circular base, the circular inner perimeter being centered on the center point of the first circular base, a plurality of inner ears protruding inwardly from the circular inner perimeter, the circular inner perimeter and the plurality of inner ears defining an opening in the first circular base, and a plurality of inner uprights being respectively connected to each of the plurality of inner ears at a bottom end of each of the plurality of inner uprights, the plurality of inner uprights being substantially parallel with each other and being substantially perpendicular to the first circular base; and a second stem comprising:

a second circular base having a second circular outer perimeter centered on a second center point of the second circular base, a second plurality of outer ears protruding outwardly from the second circular outer perimeter, and a second plurality of outer uprights being respectively connected to each of the second plurality of outer ears at a second bottom end of each of the second plurality of outer uprights, the second plurality of outer uprights being substantially parallel with each other.

7. The system of claim 6, wherein the plurality of inner ears are located symmetrically to one another around the circular inner perimeter.

8. The system of claim 6, wherein the plurality of inner uprights are substantially parallel with the first plurality of outer uprights.

9. The system of claim 6, further comprising a top end of each of the plurality of inner uprights being connected to each other.

10. The system of claim 6, wherein the first plurality of outer uprights are greater in number than the plurality of inner uprights.

11. The system of claim 6, wherein each of the plurality of inner uprights has a cross-sectional shape comprising one of the following: circular, triangular, rectangular, pentagonal, hexagonal, heptagonal, and octagonal.

12. The system of claim 6, wherein a distance between the plurality of inner ears is defined as:

$$D=(d)(x),$$

where

D is the distance between the plurality of inner ears, d is a largest cross-sectional dimension of one of the plurality of inner uprights, and x is an integer.

13. The system of claim 6, further comprising an outer ring connected to a top end of each of the first plurality of outer uprights.

14. The system of claim 6, wherein the first plurality of outer ears are located symmetrically to one another around the circular outer perimeter.

15. The system of claim 6, further comprising:

a base plate; and a spacer between the base plate and the circular base.

16. The system of claim 6, wherein each of the first plurality of outer uprights has a cross-sectional shape comprising one of the following: circular, triangular, rectangular, pentagonal, hexagonal, heptagonal, and octagonal.

17. The system of claim 6, wherein a distance between the first plurality of outer ears is defined as:

$$D=(d)(x),$$

where

D is the distance between the first plurality of outer ears, d is a largest cross-sectional dimension of one of the first plurality of outer uprights, and x is an integer.

18. A system comprising:

a first stem comprising:

a first circular base having a first circular outer perimeter centered on a first center point of the first circular base, a first set of a plurality of outer ears protruding outwardly from the first circular outer perimeter, wherein the first set of the plurality of outer ears are configured to index with the second set of the plurality of outer uprights, and a first set of a plurality of outer uprights being respectively connected to each of the first set of the plurality of outer ears at a bottom end of each of the first set of the plurality of outer uprights, the first set of the plurality of outer uprights being substantially parallel with each other and being substantially perpendicular to the first circular base; and a second stem comprising:

a second circular base having a second circular outer perimeter centered on a second center point of the second circular base, a second set of a plurality of outer ears protruding outwardly from the second circular outer perimeter, and a second set of a plurality of outer uprights being respectively connected to each of the second set of the plurality of outer ears at a bottom end of each of the second set of the plurality of outer uprights, the second set of the plurality of outer uprights being substantially parallel with each other and being substantially perpendicular to the second circular base, the second stem being mateably stacked inside the first stem causing the first set of the plurality of outer uprights to be substantially parallel with the second set of the plurality of outer uprights, wherein the first circular base further comprises a plurality of notches configured to allow the second set of the plurality outer uprights to pass through the plurality of notches, wherein the plurality of outer ears in the first set of the plurality of outer ears are spaced a distance apart, the distance being defined as:

$$D=(d)(x),$$

where

D is the distance between the first set of the plurality of outer ears, d is a largest cross-sectional dimension of one of the second set of the plurality of outer uprights, and x is an integer.

19. A system of stackable stems, the system comprising:

a first stem comprising:

a first circular base having a first circular outer perimeter centered on a first center point of the first circular base, a first set of a plurality of outer ears protruding outwardly from the first circular outer perimeter, a first set of a plurality of outer uprights being respectively connected to each of the first set of the plurality of outer ears at a bottom end of each of the first set of the plurality of outer uprights, the first set of the plurality of outer uprights being substantially parallel with each other and being substantially perpendicular to the first circular base, a first circular inner perimeter on the first circular base, the first circular inner perimeter being centered on the first center point of the first circular base, a first set of a plurality of inner ears protruding inwardly from the first circular inner perimeter, the first circular inner perimeter and first set of the plurality of inner ears defining an opening in the first circular base, and a first set of a plurality of inner uprights being respectively connected to each of the first set of the plurality of inner ears at a bottom end of each of the first set of the plurality of inner uprights, the first set of the plurality of inner uprights being substantially parallel with each other and being substantially perpendicular to the first circular base; and a second stem comprising:

a second circular base having a second circular outer perimeter centered on a second center point of the second circular base, a second set of a plurality of outer ears protruding outwardly from the second circular outer perimeter, a second set of a plurality of outer uprights being respectively connected to each of the second set of the plurality of outer ears at a bottom end of each of the second set of the plurality of outer uprights, the second set of the plurality of outer uprights being substantially parallel with each other and being substantially perpendicular to the second circular base, the second stem being mateably stacked inside the first stem causing the first set of the plurality of outer uprights to be substantially parallel with the second set of the plurality of outer uprights, a second circular inner perimeter on the second circular base, the second circular inner perimeter being centered on the second center point of the second circular base, a second set of a plurality of inner ears protruding inwardly from the second circular inner perimeter, the second circular inner perimeter and the second set of the plurality of inner ears defining an opening in the second circular base, and a second set of a plurality of inner uprights being respectively connected to each of the set of the plurality of inner ears at a bottom end of each of the set of the plurality of inner uprights, the second set of the plurality of inner uprights being substantially parallel with each other and being substantially perpendicular to the second circular base.

20. The system of claim 19, wherein the first set of the plurality of outer ears are configured to index with the second set of the plurality of outer uprights.

21. The system of claim 19, wherein the first circular base further comprises a plurality of notches configured to allow the second set of the plurality outer uprights and the second set of the plurality of inner upright to pass through the plurality of notches.

22. The system of claim 19, wherein the plurality of outer ears in the first set of the plurality of outer ears are spaced a distance apart, the distance being defined as:

$$D=(d)(x),$$

where

D is the distance between the first set of the plurality of outer ears, d is a largest cross-sectional dimension of one of the second set of the plurality of outer uprights, and x is an integer.

23. The system of claim 19, wherein the first stem further comprises:

a first base plate; and a first spacer located between the first base plate and the circular base.

* * * * *